US006450367B1

(12) United States Patent
Sittler

(10) Patent No.: US 6,450,367 B1
(45) Date of Patent: Sep. 17, 2002

(54) COMPLETELY CLOSED DISPENSER-STOPPER WITH REINFORCED SEAL FOR BOTTLES OR OTHER CONTAINERS WITH THREADED NECKS

(76) Inventor: Jean-Pierre Sittler, 3 rue des Champs - 67230, Herbsheim (FR)

( * ) Notice: Subject to any disclaimer, the term of this patent is extended or adjusted under 35 U.S.C. 154(b) by 0 days.

(21) Appl. No.: 09/785,868

(22) Filed: Mar. 12, 2001

(51) Int. Cl.[7] ..... B67D 5/32
(52) U.S. Cl. ..... 222/39; 222/521
(58) Field of Search ..... 222/39, 519–521

(56) References Cited

U.S. PATENT DOCUMENTS

| | | | | | |
|---|---|---|---|---|---|
| 4,690,304 | A | * | 9/1987 | Morel | 222/520 |
| 4,867,354 | A | * | 9/1989 | Shreiber | 222/521 |
| 5,377,873 | A | * | 1/1995 | Minnette | 222/39 |
| 5,431,305 | A | * | 7/1995 | Kaminski | 222/521 |
| 6,244,476 | B1 | * | 6/2001 | Moretti | 222/520 |

FOREIGN PATENT DOCUMENTS

| | | |
|---|---|---|
| DE | G 86 28 092 | 10/1986 |
| FR | 2 699 506 A1 | 12/1992 |
| GB | 949180 | 5/1960 |
| WO | 97/31838 | 9/1997 |

* cited by examiner

*Primary Examiner*—Joseph A. Kaufman
(74) *Attorney, Agent, or Firm*—Davis & Bujold, P.L.L.C.

(57) ABSTRACT

The dispenser stopper (1) consists of a plug (2) to be positioned inside the container neck (4) and a closing cap (3). The plug (2) is a hollow cylindrical body with a cavity outlet defined by an upper contact collar (10). Its interior cavity comprises a central chimney (14) with a cylindrical shaft (16) with its extremity (17) connected to the shaft by three spaced apart branches (18). The chimney is surrounded by a central cylindrical shaft (23) opening into a central dispensing orifice to form the first seal. A cylindrical concentric skirt (29) forms a second seal when its lower peripheral rim (30) contacts the upper collar (10) on the plug (2). This invention is of interest to manufacturers of stoppers for flasks or other containers.

20 Claims, 5 Drawing Sheets

COMPLETELY CLOSED DISPENSER-STOPPER WITH REINFORCED SEAL FOR BOTTLES OR OTHER CONTAINERS WITH THREADED NECKS

This invention relates to a dispenser-stopper with reinforced sealing for flasks, tubes, bottles with threaded necks, or other containers.

BACKGROUND OF THE INVENTION

A dispenser-stopper has already been disclosed in PCT Application Publication No. WO 97/31838 filed by BORMIOLI ROCCO Spa.

This dispenser-stopper is formed of two parts: first, the plug, which pivots and locks onto the exterior of the container neck; and second, a cap with an upper outlet orifice, which covers the stopper and is maintained in place on it with cooperating pins and threaded surfaces requiring a quarter turn formed in the interior surface of the lateral wall of the cap.

The pins present on the plug engage in lateral entry points and lateral grooves lead the pins to angled areas when the cap is positioned on the plug.

Pivoting the cap a one-quarter rotation produces sufficient amplitude of movement to allow it to completely block the upper outlet orifice at the completion of rotation.

The blocking action occurs when the conical extremity of a central stem in the plug penetrates the opening on the interior conical rim of the cap.

Each of the two pieces of this stopper has a complex technical form. Manufacturing them using a molding process requires a complicated, expensive mold.

In addition, the mechanized operations involved in positioning the cap on the plug represent a succession of difficult to achieve steps with significant speed limitations.

Moreover, even if the primary seal is reliable, the seal is not reliably watertight for all liquids. For this reason, this type of stopper is used primarily for paste or semi-liquid products.

SUMMARY OF THE INVENTION

The principal object of the invention is to provide a complete, reliable sealing at every level.

Another aim of the invention is to provide a stopper that is modest in cost and easy to manufacture, with various supplementary features such as a signal indicating when it is closed or beginning to open, the ability to fit normal bottle necks, and recyclability.

To accomplish this, the invention concerns a dispenser-stopper for flasks, tubes, bottles or other containers with threaded necks, formed of a plug and a cap with a central outlet opening on its upper surface that can be partially and totally blocked by screwing the cap onto the threaded neck, characterized in that the stopper is positioned inside the threaded bottle neck, in that the stopper is a hollow body with a free opening in the interior cavity defined by an upper annular contact collar and occupied by a central chimney with a product outlet zone and a blocking extremity designed to occupy the space within the central orifice of the capsule, said capsule being a hollow cylindrical body with a threaded interior lateral surface, a cylindrical central shaft opening toward the outside and surrounding the central chimney of the plug, with the interior cavity of the cap having a cylindrical skirt concentric to the central shaft, the lower, free end of which forms a seal by contacting the upper annular collar of the plug.

The interior lateral surface of the plug and the exterior surface of the central shaft are each further provided with a separating partition perpendicular to said surface which blocks pivoting movement.

Beyond the important advantages offered by the multiple means and areas which form seals between the various elements and the container neck, the following additional features are noteworthy:

- the simple technical form of the two elements;
- ease of molding;
- low cost for material and manufacture;
- ease of attachment to the container; and
- adaptability to all standard bottle necks of corresponding size.

BRIEF DESCRIPTION OF THE DRAWINGS

Other characteristics and features of the invention will be apparent from the following description, provided byway of example, and the accompanying drawings, in which.

DESCRIPTION OF PREFERRED EMBODIMENTS

Figure 1:
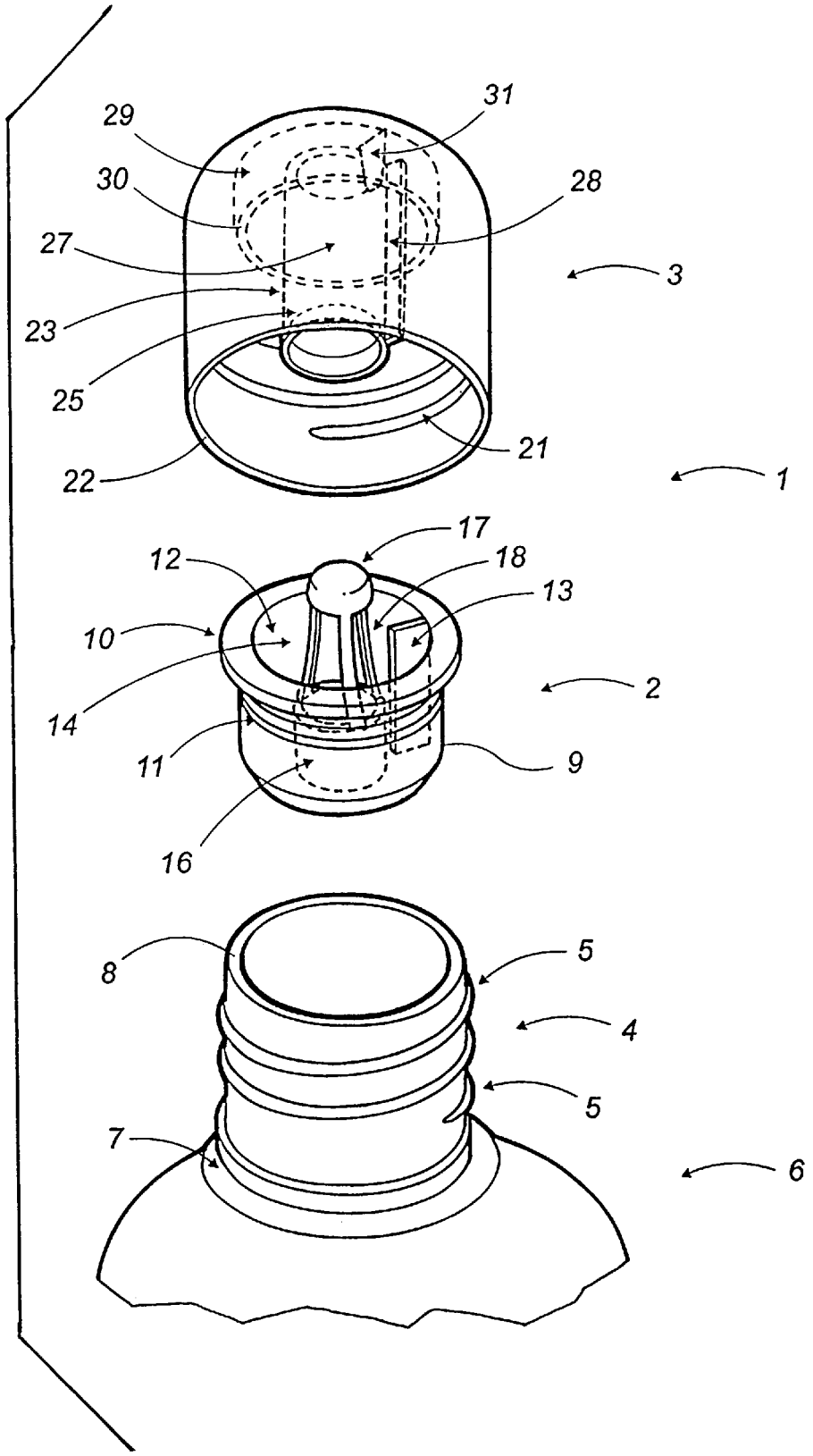
FIG. 1 is a perspective of a dismantled stopper according to the invention showing the cap and the plug facing a container neck.
Figure 2:
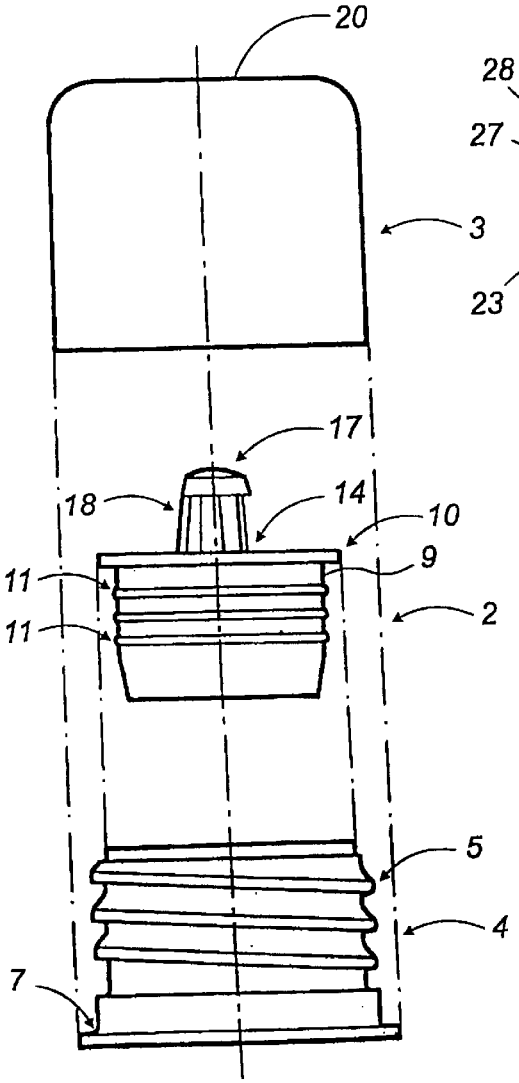
FIG. 2 is a profile of a dismantled stopper according to the invention facing a container neck.
Figure 3:
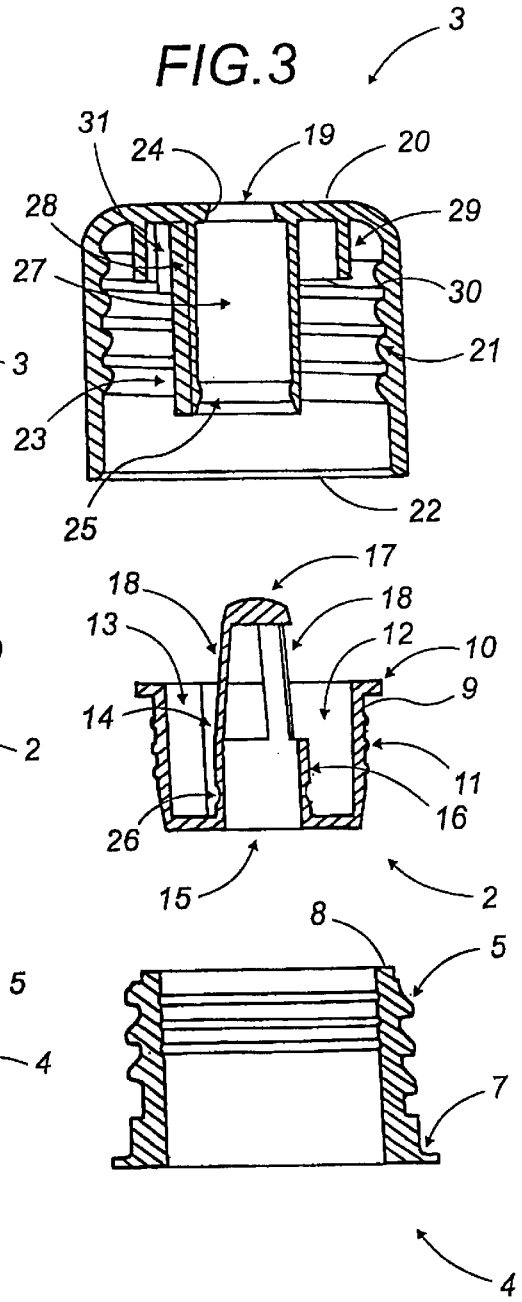
FIG. 3 is the same type of view, but in transverse cross-section.

The dispenser-stopper 1 according to the invention is the two-part type, having a plug 2 and a cap or cover 3. This screws onto a threaded container neck 4, with threads 5 formed in the material comprising the flask 6, bottle, can, tube, or any other container or receptacle, which may or may not have a neck with a collar 7 as shown in FIG. 1. The bottle neck terminates in a flat, upper annular rim 8.

Plug 2 is a piece that is generally cylindrical in shape and hollow, with its lateral surface 9 and an upper collar 10 designed to contact the upper rim 8 of container neck 4.

Lateral surface 9 of this stopper is fitted into the interior diameter of the container neck and it comprises a raised sealing area, for example, three parallel ribs such as ribs 11 forming raised annular ridges.

As indicated, these raised structures ensure sealing between the container neck and the body of plug 2 by pressing against the interior lateral surface of the container neck material 4.

As FIG. 1 shows, the piece that serves as a stopper 2 has an interior cavity 12 occupied by a separating partition 13 essentially perpendicular to the interior lateral surface. Stopper 2 has, in the central position, a central outlet chimney 14 formed of a central inlet orifice 15 at the lower extremity of a central cylindrical shaft 16 defined by a cylindrical wall. This outlet chimney 14 terminates in a blocking extremity 17 connected to cylindrical wall 16 with three branches such as branches 18 which are spaced apart from one another and equidistant. The branches are thin but strong enough to provide a tight mechanical grip.

The blocking extremity forms a slightly conical nipple 17 providing a tight seal for the cap's outlet passageway when it is inside the blocking extremity and engaged in the outlet passageway to close it.

Since stopper 2 is fixed and engaged with container neck 4, it is the cap or cover that is displaced translationally forward or backward, respectively, when it is screwed or unscrewed in order to open or block central dispensing orifice 19 formed in the upper surface of cap 3.

Cap or cover 3 is also a hollow piece generally cylindrical in shape with a flat or slightly convex, curved upper surface 20. The interior of the lateral surface has a threaded portion 21 adapted to the threaded portion of container neck 4 so the cap can be screwed onto neck 4 between a totally closed position, in which lower rim 22 of the cap rests on collar 7 of the neck to form a primary seal, and an opening position in which cap 3 is unscrewed by approximately one rotation.

The central portion of the interior of the cap is occupied by a central shaft 23 forming a cylindrical channel opening onto the upper surface through central dispensing outlet 19, which is narrower than cylindrical channel 23 and has a conical, upward-angled rim 24.

Cylindrical channel 23 has at its base an interior rounded peripheral protrusion forming an annular ridge 25 which rests on the exterior wall of shaft 16 constituting the cylindrical base of outlet chimney 14, either directly, using pressure, or by engaging a cog 26 provided for this purpose.

When the cap is in place and screwed onto container neck 4, channel 23 defines an interior space 27 tightly sealed at the bottom by annular ridge 25 contacting cylindrical shaft 16 and open at the top at central dispensing outlet 19, which is partially or completely plugged by blocking extremity 17.

The cylindrical wall of channel 23 has an exterior lateral extension in the form of a partition-block 28, which may be radially arranged, serving as a stop surface cooperating with partition 13 of plug 2. When these two partitions 13 and 28 move into abutment, the screwing action stops because the cap is completely screwed on and the sealing contacts have been established. It is actually the cap which then causes the stopper to pivot inside the bottle neck, since it is fitted inside the neck but not locked.

The cap also has a interior skirt 29 concentric with central cylindrical channel 23 in the form of a cylindrical wall surrounding it and integral with the upper wall of the cap. The lower edge 30 of this skirt blocks and seals upper collar 10 of plug 2 to form a supplemental seal between the plug and the remaining interior space within cap 3.

To produce an auditory signal when the bottle is closed or beginning to open, a "click" sound is created by a flexible spline located inside the cap, projecting from the upper wall and extending down. This flexible spline 31 bends as it passes along the wall of the plug and when it is freed, there is a "click" sound indicating it has cleared this point.

Figure 10:
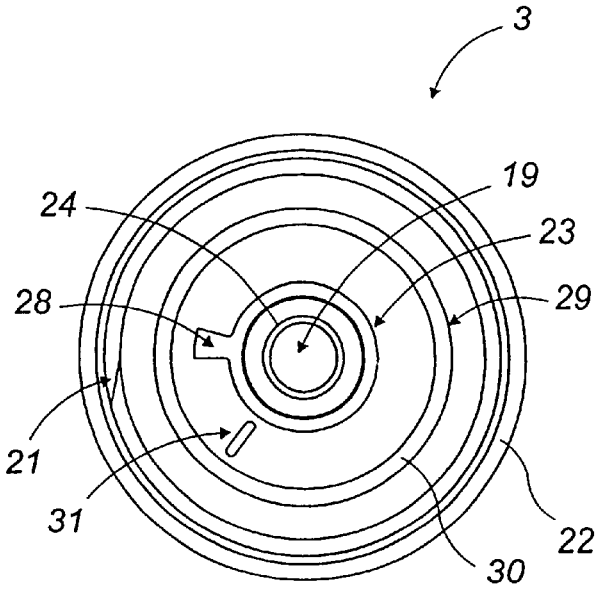
FIG. 10 is a view from beneath the cap showing the threaded interior surface of its lateral wall.

There is a slight angular offset between spline 31 and blocking wall 28, as seen in FIG. 10. It arrives at the beginning of the closing operation, that is, when the blocking extremity occupies the entire space within central dispensing orifice 19, but before the conical angled portions are tightly pressed against one another.

One of the features of the invention is that the dispenser-stopper may be positioned on any standard size container neck having the same dimensions, while stopper element 2 is engaged within cap or cover 3 with its interior shaft attached to shaft 16 of central chimney 18, at a predetermined angular orientation.

Figure 11:
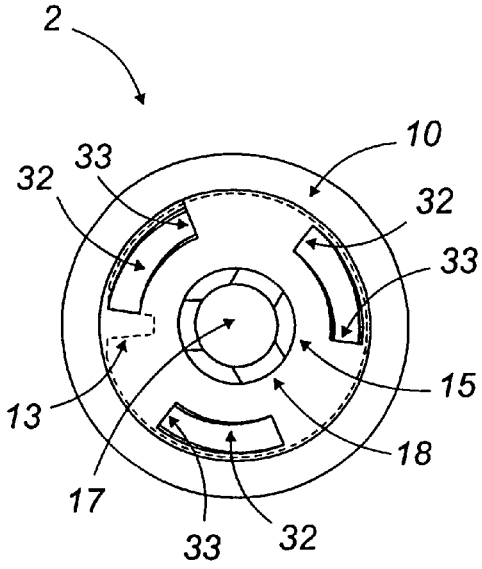
FIG. 11 is a view from beneath the plug showing a variation with angled three positioning elements.
Figure 12:
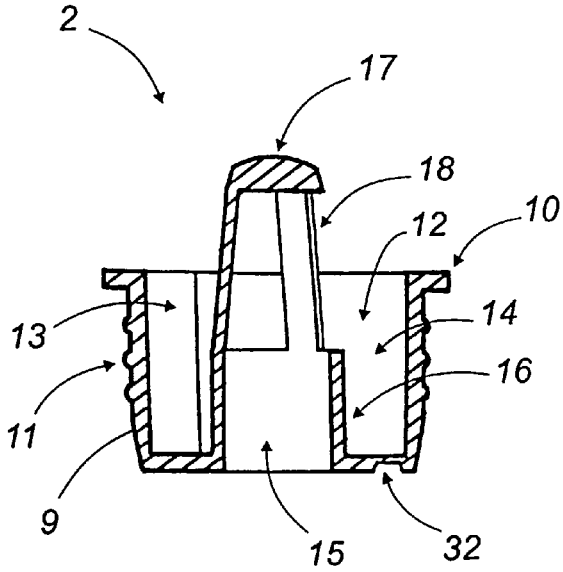
FIG. 12 is a transverse cross-section of the cap showing the cross-section of an angled positioning element.

For this reason, according to a variation represented only in FIGS. 11 and 12, a series of three indentations such as indentations 32 are formed in the sub-surface of the stopper element, consisting of three portions with downward sloped curved surfaces in a clockwise orientation. Transverse front portion 33, determined by the depth at the end of each of these portions, constitutes a block when the multiple claws of a pivot head tool are introduced.

Figure 4:
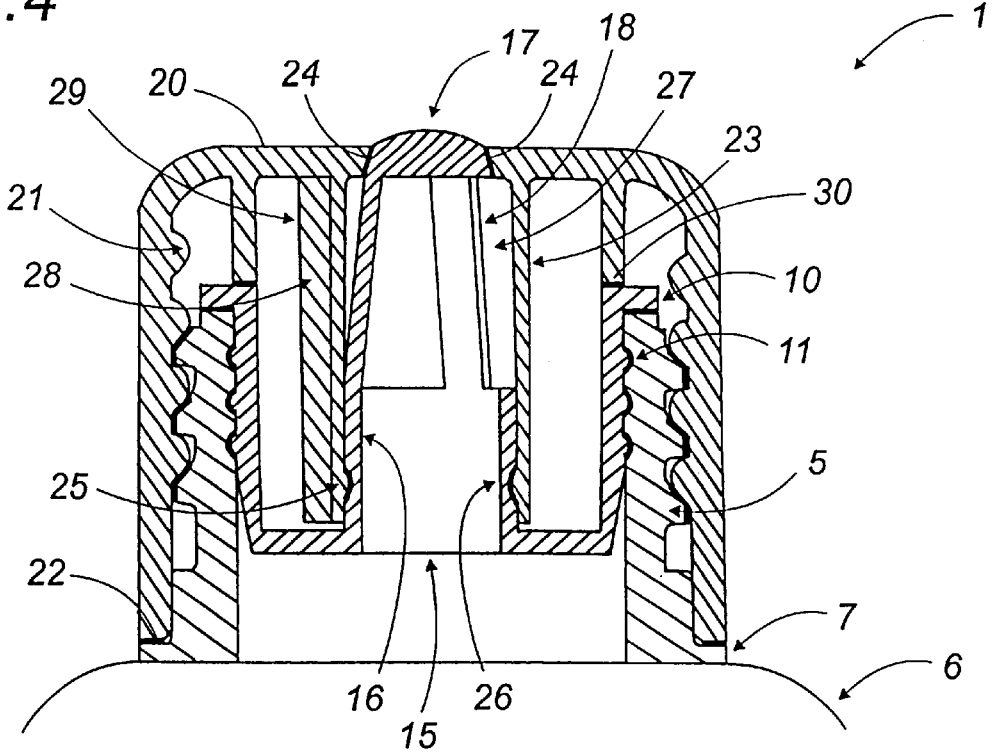
FIG. 4 is a transverse cross-section of the stopper according to the invention attached to the neck of a flask, with the sealed contact areas shown in bold.
Figure 5:
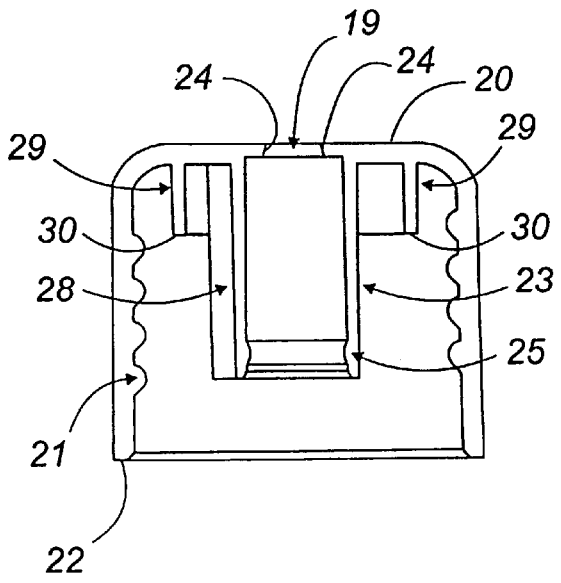
FIGS. 5 and 6 are transverse cross-sections in the area of the angular stop partition and the spline producing the auditory signal.
Figure 6:
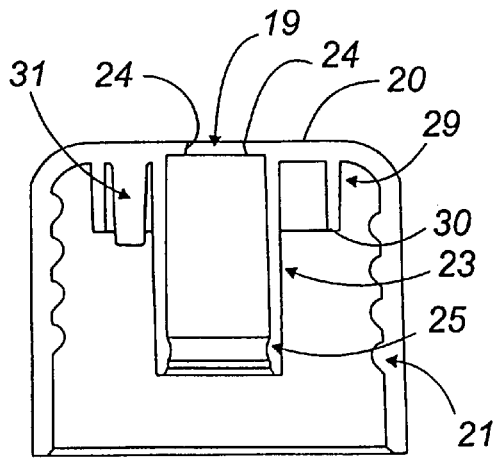
Figure 7:
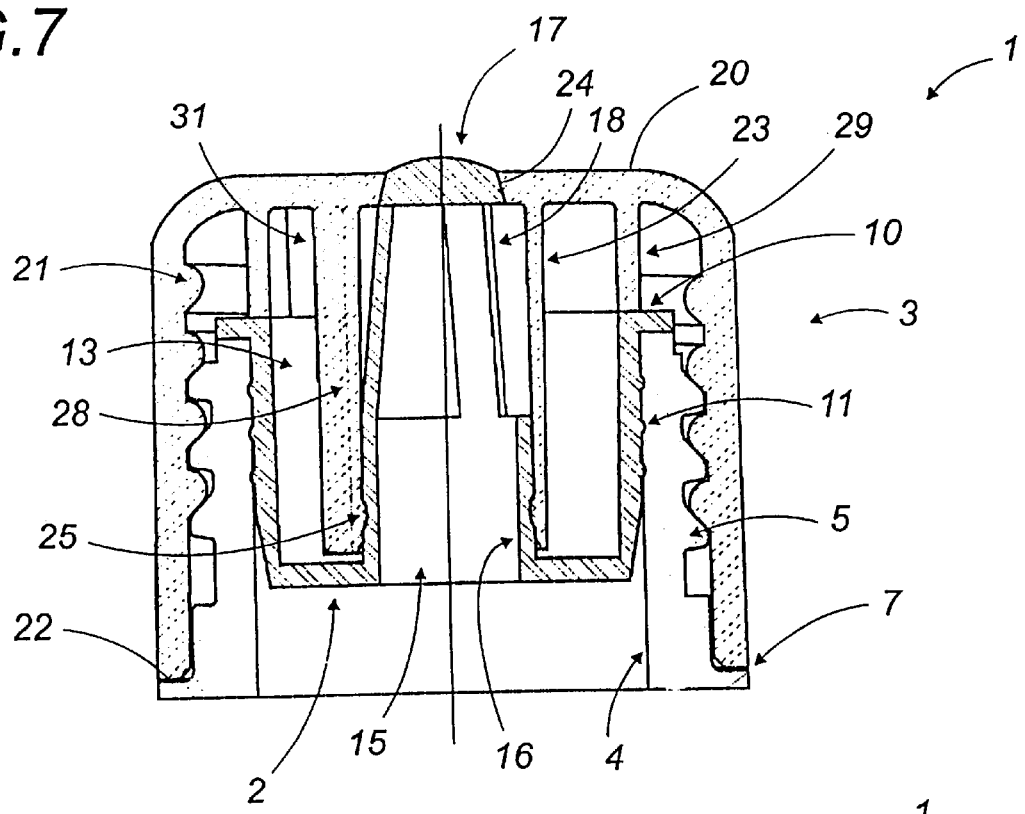
FIGS. 7 and 8 are transverse cross-sections of the dispenser-stopper according to the invention in the closed position and the open position, respectively.
Figure 8:
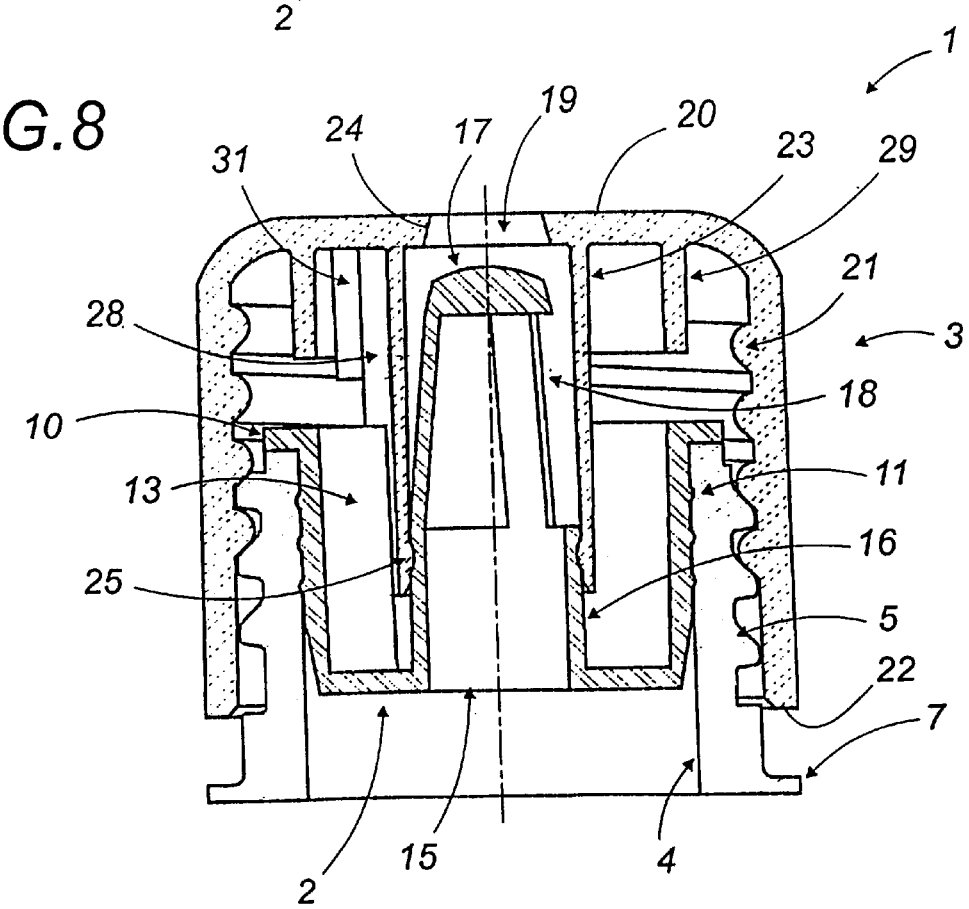
Figure 9:
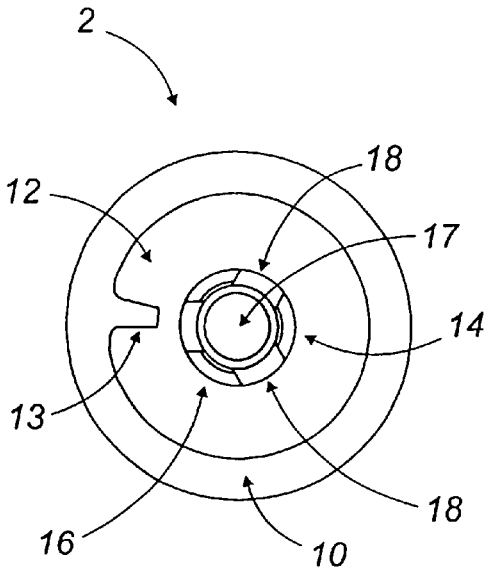
FIG. 9 is an overhead view of the isolated plug.

To ensure completely reliable operation, the stopper of the invention has at least six sealing zones shown by the bold lines in FIG. 4.

First, there is the seal between the lower edge of cap 3 and the collar on container neck 4.

Next, there is the seal formed by the threaded area.

Next, there is the seal represented by the contact between upper collar 10 on stopper 2 and upper edge 8 of container neck 4.

There is also a seal produced by the contact between the lower edge of interior sealing skirt 29 and the upper edge of upper collar 10 of stopper 2.

In addition, there is a seal between shaft 16 in central chimney 14 of stopper 2 and central channel 23 in cap 3.

Finally, there is the seal formed when the plug is closed at the level of dispensing orifice 19 when the contact of the two conical angled areas are in contact: the angled area on nipple 17 and on the opening.

When the stopper is being manufactured, the final phase consists of introducing plug 2 inside cap 3 and immobilizing it in a predetermined position or an angular orientation relative to it.

Thus, the stoppers are delivered assembled for high-speed, mechanized positioning on the threaded neck of each container after it has been filled.

Obviously they are positioned in such a way that the stopper is completely closed at the end of the operation.

With regard to its use as a dispenser-stopper, since the device is sealed in several locations, the central dispensing orifice is partially or totally opened by pivoting the body of the cap on itself. Unscrewing opens the orifice and screwing closes it.

After the first fractional angular movement which produces the audible click signal, the opening process begins and proceeds until the device is completely open as the cap body moves in translation while the unscrewing action progresses.

Conversely, the device may be considered completely closed when the screwing action produces the audible signal and the screwing action is blocked. All the contact seals have then been established in the plurality of areas involved and even the slightest leak of the contents to the outside is impossible.

The importance of this invention lies not only in its capacity to guaranty sealing, but also in its practical features, particularly maneuverability.

What is claimed is:

1. A dispenser-stopper for a container (6) having a neck (4) with an exterior thread, the dispenser-stopper having a reinforced seal stopper and comprising:

a plug (2) having a centrally located blocking extremity (17), the plug (2) being sized to be captively received by the neck (4) of the container; and a cap (3) having a conical rim formed in an upper surface thereof defining a dispensing orifice (19), and an inwardly facing lateral surface of the cap (3) carrying a thread for matingly engaging with the exterior thread of the neck to facilitate rotation of the cap relative to the neck (4); the dispensing orifice (19) of the cap (3) being totally blocked by the blocking extremity (17) when the cap (3) is rotated relative to the neck (4) to a close position, and the blocking extremity (17) being sufficiently spaced from the dispensing orifice (19), when the cap (3) is rotated relative to the neck (4) to an open position, to at least partially open the dispensing orifice (19) and allow flow therethrough;

wherein the plug (2) is captively received by and attached to the neck (4) of the container by forcing the plug (2) into an opening defined by the neck, the plug (2) is a hollow body which has an interior cavity (12) defined by an annular collar (10), the plug (2) has a central chimney (14) with passageway formed therein to allow flow therethrough, and a free end of the chimney (14) supports the blocking extremity (17); and the cap comprises a hollow cylindrical body, a cylindrical central shaft (23) is concentric with the dispensing orifice (19) and surrounds the central chimney (14), an interior skirt (20) surrounds and is concentric with the central shaft (23), and a free perimeter edge (30) of the interior skirt (20) forms a seal with an adjacent surface of the annular collar (10) when the cap (3) is rotated, relative to the neck (4), to the close position.

2. The dispenser-stopper according to claim 1, wherein an interior lateral surface of the plug (2) and the exterior surface of the central shaft (23) each have a blocking partition (13 and 28), and when the blocking partitions (13 and 28) engage with one another, the blocking partition (13 and 28) prevent further rotation of the cap (3) relative to the plug (2) in one direction.

3. The dispenser-stopper according to claim 1, wherein the thread of the cap (3) and the thread of the neck (4) facilitate screwing the cap onto the neck (4) until the cap is in the close position with a lower rim (22) of the cap abutting against a collar (7) of the container neck.

4. The dispenser-stopper according to claim 1, wherein the central chimney (14) has a central inlet orifice (15) located at a lower extremity thereof, and a central shaft (16) separates the passageway of the chimney (14) from a remainder of the interior cavity (12), and the blocking extremity (17) terminates the chimney (14).

5. The dispenser-stopper according to claim 4, wherein the blocking extremity (17) is connected to the central shaft (16) by at least two branches (18), and the at least two branches (18) are spaced apart from one another.

6. The dispenser-stopper according to claim 4, wherein the blocking extremity (17) is connected to the central shaft (16) by three branches (18), and the three branches (18) are equally spaced apart from one another.

7. The dispenser-stopper according to claim 4, wherein a peripheral protrusion (25) is provided on an interior surface of the central shaft (23) for engaging with an exterior wall of the central shaft (16).

8. The dispenser-stopper according to claim 7, wherein a cog (26) is provided on the exterior surface of the central shaft (16) for engaging with the peripheral protrusion (25) of the central shaft (23).

9. The dispenser-stopper according to claim 1, wherein the blocking extremity (17) has a slightly conical shaped nipple which cooperates with the conical rim (24) defining the dispensing orifice (19).

10. The dispenser-stopper according to claim 1, wherein an exterior lateral surface (9) of the plug (2) has a raised sealing area to facilitate the neck (4) captively receiving the plug (2).

11. The dispenser-stopper according to claim 10, wherein the raised sealing area comprises at least one annular rib (11) formed in the exterior lateral surface (9) of the plug (2).

12. The dispenser-stopper according to claim 1, wherein the upper surface of the cap (3) has a flexible spline (31), and the spline (31) interacts with the plug (2) to produce an auditory sound when the cap (3) is one of terminates closing and commences opening.

13. The dispenser-stopper according to claim 12, wherein the exterior surface of the central shaft (23) has a blocking partition (28) and a small angular offset is provided between the spline (31) and the blocking partition (28).

14. The dispenser-stopper according to claim 1, wherein a sub-surface of the plug has at least one indentation (32) formed therein which comprises a stop for engaging with a tool for gripping the plug and facilitating positioning of the plug within the cap during assembly of the dispenser-stopper.

15. The dispenser-stopper according to claim 14, wherein the at least one indentation (32) is a downward angled curved portion.

16. A dispenser-stopper for a container (6) having a neck (4) with an exterior thread, the dispenser-stopper having a reinforced seal stopper and comprising:

a plug (2) having a centrally located blocking extremity (17), the plug (2) being sized to be captively received by the neck (4) of the container; and a cap (3) having a conical rim formed in an upper surface thereof defining a dispensing orifice (19), and an inwardly facing lateral surface of the cap (3) carrying a thread for matingly engaging with the exterior thread of the neck to facilitate rotation of the cap relative to the neck (4); the dispensing orifice (19) of the cap (3) being totally blocked by the blocking extremity (17) when the cap (3) is rotated relative to the neck (4) to a close position, and the blocking extremity (17) being sufficiently spaced from the dispensing orifice (19), when the cap (3) is rotated relative to the neck (4) to an open position, to at least partially open the dispensing orifice (19) and allow flow therethrough;

wherein the plug (2) is captively received by and attached to the neck (4) of the container by forcing the plug (2) into an opening defined by the neck, the plug (2) is a hollow body which has an interior cavity (12) defined by an annular collar (10), the plug (2) has a central chimney (14) with passageway formed therein to allow flow therethrough, and a free end of the chimney (14) supports the blocking extremity (17);

the cap comprises a hollow cylindrical body, a cylindrical central shaft (23) is concentric with the dispensing orifice (19) and surrounds the central chimney (14), an interior skirt (20) surrounds and is concentric with the central shaft (23), and a free perimeter edge (30) of the interior skirt (20) forms a seal with an adjacent surface of the annular collar (10) when the cap (3) is rotated, relative to the neck (4), to the close position; and the upper surface of the cap (3) has a flexible spline (31), and the spline (31) interacts with the plug (2) to produce an auditory sound when the cap (3) is one of terminates closing and commences opening.

17. The dispenser-stopper according to claim 16, wherein the exterior surface of the central shaft (23) has a blocking partition (28) and a small angular offset is provided between the spline (31) and the blocking partition (28).

18. A dispenser-stopper for a container (6) having a neck (4) with an exterior thread, the dispenser-stopper having a reinforced seal stopper and comprising:

a plug (2) having a centrally located blocking extremity (17), the plug (2) being sized to be captively received by the neck (4) of the container; and a cap (3) having a conical rim formed in an upper surface thereof defining a dispensing orifice (19), and an inwardly facing lateral surface of the cap (3) carrying a thread for matingly engaging with the exterior thread of the neck to facilitate rotation of the cap relative to the neck (4); the dispensing orifice (19) of the cap (3) being totally blocked by the blocking extremity (17) when the cap (3) is rotated relative to the neck (4) to a close position, and the blocking extremity (17) being sufficiently spaced from the dispensing orifice (19), when the cap (3) is rotated relative to the neck (4) to an open position, to at least partially open the dispensing orifice (19) and allow flow therethrough;

wherein the plug (2) is captively received by and attached to the neck (4) of the container by forcing the plug (2) into an opening defined by the neck, the plug (2) is a hollow body which has an interior cavity (12) defined by an annular collar (10), the plug (2) has a central chimney (14) with passageway formed therein to allow flow therethrough, and a free end of the chimney (14) supports the blocking extremity (17);

the cap comprises a hollow cylindrical body, a cylindrical central shaft (23) is concentric with the dispensing orifice (19) and surrounds the central chimney (14), an interior skirt (20) surrounds and is concentric with the central shaft (23), and a free perimeter edge (30) of the interior skirt (20) forms a seal with an adjacent surface of the annular collar (10) when the cap (3) is rotated, relative to the neck (4), to the close position; and a sub-surface of the plug has at least one indentation (32) formed therein which comprises a stop for engaging with a tool for gripping the plug and facilitating positioning of the plug within the cap during assembly of the dispenser-stopper.

19. The dispenser-stopper according to claim 18, wherein the at least one indentation (32) is a downward angled curved portion.

20. A dispenser-stopper for a container (6) having a neck (4) with an exterior thread, the dispenser-stopper comprising:

a plug (2) having a blocking extremity (17), the plug (2) being sized to be captively received by the neck (4) of the container; and a cap (3) having a rim formed in an upper surface thereof defining a dispensing orifice (19), and an inwardly facing lateral surface of the cap (3) carrying a thread for matingly engaging with the exterior thread of the neck to facilitate rotation of the cap relative to the neck (4); the dispensing orifice (19) of the cap (3) being totally blocked by the blocking extremity (17) when the cap (3) is rotated relative to the neck (4) to a close position, and the blocking extremity (17) being sufficiently spaced from the dispensing orifice (19), when the cap (3) is rotated relative to the neck (4) to an open position, to at least partially open the dispensing orifice (19) and allow flow therethrough;

wherein the plug (2) is captively received by and attached to the neck (4) of the container by forcing the plug (2) into an opening defined by the neck, the plug (2) is a hollow body which has an interior cavity (12) defined by an annular collar (10), the plug (2) has a central chimney (14) with passageway formed therein to allow flow therethrough, and a free end of the chimney (14) supports the blocking extremity (17);

the cap comprises a hollow cylindrical body, a cylindrical central shaft (23) is concentric with the dispensing orifice (19) and surrounds the central chimney (14), an interior skirt (20) surrounds and is concentric with the central shaft (23), and a free perimeter edge (30) of the interior skirt (20) forms a seal with an adjacent surface of the annular collar (10) when the cap (3) is rotated, relative to the neck (4), to the close position; and an interior lateral surface of the plug (2) and the exterior surface of the central shaft (23) each have a blocking partition (13 and 28), and when the blocking partitions (13 and 28) engage with one another, the blocking partition (13 and 28) prevent further rotation of the cap (3) relative to the plug (2) in one direction.

* * * * *

UNITED STATES PATENT AND TRADEMARK OFFICE

CERTIFICATE OF CORRECTION

PATENT NO. : 6,450,367 B1
DATED : September 17, 2002
INVENTOR(S) : Jean-Pierre Sittler It is certified that error appears in the above-identified patent and that said Letters Patent is hereby corrected as shown below:

Title page,
Replace Item [22], with: -- [22] Filed: Feb. 16, 2001 --

Signed and Sealed this

Eleventh Day of March, 2003

JAMES E. ROGAN
*Director of the United States Patent and Trademark Office*